US012728312B2

(12) United States Patent
Wilfert et al.

(10) Patent No.: US 12,728,312 B2
(45) Date of Patent: Sep. 8, 2026

(54) EXERCISE BIKE

(71) Applicant: Muoverti Limited, Oxford (GB)

(72) Inventors: Christoph Wilfert, Oxford (GB); Chris Staunton, Oxford (GB); Andy Hibberd, Oxford (GB)

(73) Assignee: Muoverti Limited (GB)

( * ) Notice: Subject to any disclaimer, the term of this patent is extended or adjusted under 35 U.S.C. 154(b) by 0 days.

(21) Appl. No.: 18/687,622

(22) PCT Filed: Sep. 1, 2022

(86) PCT No.: PCT/GB2022/052236
§ 371 (c)(1),
(2) Date: Feb. 28, 2024

(87) PCT Pub. No.: WO2023/031611
PCT Pub. Date: Mar. 9, 2023

(65) Prior Publication Data

US 2025/0135272 A1 May 1, 2025

(30) Foreign Application Priority Data

Sep. 1, 2021 (GB) ..... 2112455

(51) Int. Cl.
*A63B 22/06* (2006.01)

(52) U.S. Cl.
CPC .. *A63B 22/0605* (2013.01); *A63B 2022/0641* (2013.01)

(58) Field of Classification Search
CPC ..... A63B 22/0605; A63B 2022/0641; A63B 2210/50; A63B 21/225; A63B 22/0046
See application file for complete search history.

(56) References Cited

U.S. PATENT DOCUMENTS

| | | | | |
|---|---|---|---|---|
| 4,824,132 | A | 4/1989 | Moore | |
| 5,044,627 | A * | 9/1991 | Huang | A63B 22/0012 482/115 |
| 7,927,258 | B2 * | 4/2011 | Irving | A63B 21/225 482/57 |
| 11,918,850 | B2 * | 3/2024 | Logan | A63B 22/0605 |
| 2016/0375299 | A1 | 12/2016 | Irving | |
| 2017/0136293 | A1 * | 5/2017 | Caccia | A63B 21/225 |
| 2020/0122011 | A1 | 4/2020 | Papadopoulos | |
| 2021/0146198 | A1 * | 5/2021 | Hawkins, III | A63B 21/225 |

FOREIGN PATENT DOCUMENTS

| | | | | |
|---|---|---|---|---|
| AU | 2023309339 | A1 * | 3/2025 | A63F 13/245 |
| CN | 105327485 | A | 2/2016 | |
| CN | 105963914 | A | 9/2016 | |

(Continued)

OTHER PUBLICATIONS

PCT/GB2022/052236—International Search Report and Written Opinion—Mailed Jan. 4, 2023.

*Primary Examiner* — Andrew M Kobylarz
(74) *Attorney, Agent, or Firm* — Christopher A. Proskey; BrownWinick Law Firm

(57) ABSTRACT

An exercise bike comprising: a base, comprising a drive module and a steering module, the drive module comprising a pedal arrangement operatively connected to a resistance arrangement, and the steering module comprising a rotatable member; and a bike frame removably attachable to the base.

20 Claims, 6 Drawing Sheets

(56) References Cited

FOREIGN PATENT DOCUMENTS

| | | | | | |
|---|---|---|---|---|---|
| CN | 106581989 | A | | 4/2017 | |
| CN | 108969986 | A | | 12/2018 | |
| GB | 2520677 | A | | 6/2015 | |
| GB | 2616310 | A | * | 9/2023 | ..... A63B 71/0622 |
| WO | 2007055584 | A1 | | 5/2007 | |
| WO | WO-2018027216 | A1 | * | 2/2018 | ..... A63B 69/16 |
| WO | 2021041967 | A1 | | 3/2021 | |

* cited by examiner

EXERCISE BIKE

FIELD

The present invention relates to an exercise bike and to an exercise bike kit.

BACKGROUND

Static exercise bikes are well known, comprising a base, a frame and a drive module. The drive module typically includes a pedal arrangement which is operably connected to a source of resistance (such as a flywheel and adjustable brake). The drive module is mounted on the frame, and the frame is mounted to, or integrally formed with, the base. The bike comprises a saddle and handlebar. The position of the saddle and/or handlebar is adjustable by a user.

In conventional exercise bikes, the frame is rigidly attached to the base such that it remains substantially upright in use. Consequently, the conventional exercise bike does not emulate the true motion of a proper (non-static) bike, which may tilt/rock about a longitudinal axis as the user applies force through the pedals, turns, and/or shifts their weight from side to side. A conventional exercise bike also does not allow the user to rotate the handlebars.

Articulating exercise bikes have previously been proposed, including by the present applicant in GB2520677. Such exercise bikes provide a more realistic road feel to the user.

The present invention seeks to provide an improved exercise bike.

BRIEF DESCRIPTION OF THE INVENTION

Accordingly, the present invention provides an exercise bike comprising:

a base, comprising a drive module and a steering module, the drive module comprising a pedal arrangement operatively connected to a resistance arrangement, and the steering module comprising a rotatable member; and a bike frame removably attachable to the base.

In at least one embodiment, the bike frame is removably attachable to the drive module.

In at least one embodiment, the bike frame is removably attachable to the steering module.

In at least one embodiment, the bike frame further comprises a head tube and a steering actuator, the steering actuator comprising a steering post with a handlebar attached thereto, the steering post rotatably received in the head tube.

In at least one embodiment, the steering post is removably attachable to the rotatable member of the steering module.

In at least one embodiment, the steering module comprises a first member and a second member, wherein the first member is secured to the base and the second member is coaxially journaled to the first member, for rotation about a steering axis.

In at least one embodiment, the second member is biased towards a predetermined angular position about the steering axis, relative to the first member.

In at least one embodiment, the steering module further comprises a resilient member attached between the first and second members, configured to resist rotation of the second member relative to the first member away from a predetermined angular position.

In at least one embodiment, one of the steering actuator and steering module is provided with a first connector which is configured to be removably secured to a corresponding second connector provided on the other of the steering module and steering actuator.

In at least one embodiment, one of the drive module and bike frame is provided with a first connector which is configured to be removably secured to a corresponding second connector provided on the other of the bike frame and drive module.

In at least one embodiment, the steering module and/or drive module are mounted for rotation about the longitudinal axis of the base.

In at least one embodiment, the steering module and/or drive module are biased into a predetermined angular position about the longitudinal axis of the base.

In at least one embodiment, a biasing force is provided by an elastomeric element.

In at least one embodiment, the height of the steering module and/or drive module relative to the base is adjustable.

In at least one embodiment, the bike frame is mounted for rotation about a pitch axis perpendicular to the longitudinal axis of the base.

In at least one embodiment, the pitch axis is in proximity to or substantially coaxial with the rotational axis of the pedal arrangement.

In at least one embodiment, the exercise bike further comprises a seat post having a saddle attached thereto, wherein the frame comprises a seat tube and down tube, and the seat post is received in the seat tube.

In at least one embodiment, the exercise bike is configured such that rotation of the seat post in a predetermined direction within the seat tube selectively retains the bike frame on the base.

In at least one embodiment, the position of the drive module relative to the steering module is adjustable.

In at least one embodiment, the frame comprises at least one user input/output device connected to an interface terminal, wherein the base comprises a corresponding interface connector for connection to the interface terminal for communication with the input/output device.

In at least one embodiment, the exercise bike further comprises at least one controller.

In at least one embodiment, the resistance arrangement comprises a motor and/or flywheel.

There is also provided an exercise bike kit comprising the exercise bike as disclosed herein, comprising a plurality of said bike frames.

In at least one embodiment, the plurality of bike frames are dissimilar in at least one of size, geometry, style, colour, surface decoration, groupset, pattern, shape or discipline.

BRIEF DESCRIPTION OF THE FIGURES

In order that the present disclosure may be more readily understood, preferable embodiments thereof will now be described, by way of example only, with reference to the accompanying drawings, in which.

DETAILED DESCRIPTION OF THE DISCLOSURE

Figure 1:
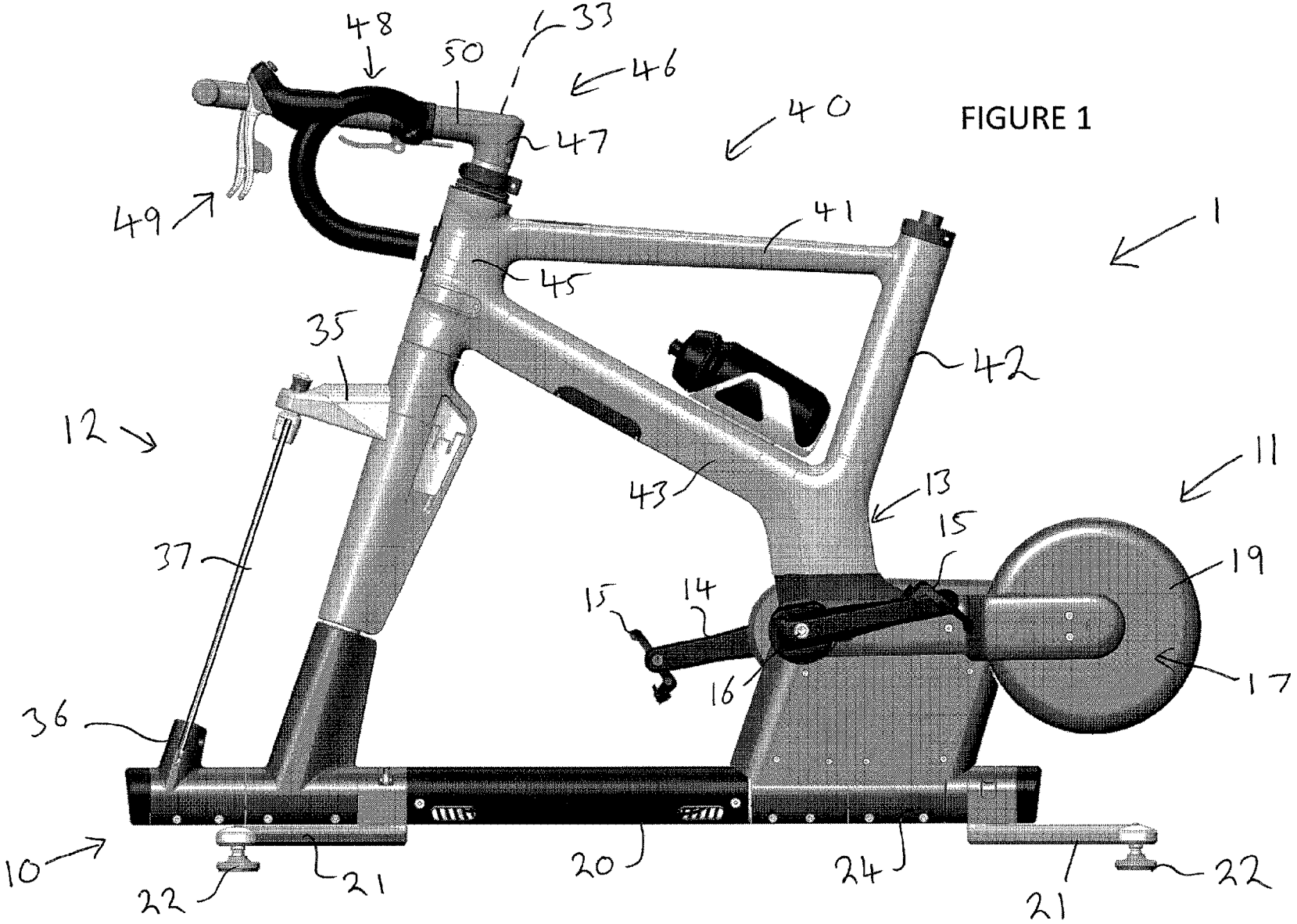
FIG. 1 illustrates a side view of an exercise bike embodying the present invention.

FIG. 1 illustrates an exercise bike 1 embodying the present invention. Generally, the exercise bike 1 comprises a base 10 and a bike frame 40 removably attachable to the base 10.

The base 10 comprises a drive module 11 and a steering module 12. Generally, the drive module 11 is configured to emulate the feel of propelling a bicycle; and the steering module 12 is configured to emulate the feeling of steering a bicycle.

The drive module 11 comprises a pedal arrangement 13. The pedal arrangement 13 comprises a pair of crank arms 14 and a pair of pedals 15, with a pedal 15 attached to the distal end of each crank arm 14. The pedals 15 may take any conventional form. The crank arms 14 may be mounted to a crank spindle (not shown), which has a rotational pedal axis 16. The length of the crank arms 14 and/or the distance between the pedals 15 and the pedal axis 16 may be adjustable. The pedal arrangement 13 may further comprise at least one chain ring 25 (partially seen in FIG. 5) which is secured to the spindle such that rotation of the pedal arrangement 13 causes rotation of the chain ring 25 about the pedal axis 16.

The drive module 11 further comprises a resistance arrangement 17. The resistance arrangement 17 may take a conventional form, such as a flywheel. The inertia of the flywheel may help to simulate the feel of riding a bicycle. A brake arrangement may be provided, to selectively provide resistance to the rotation of the flywheel. The extent of resistance may be controlled by a user and/or control system. Alternatively, the resistance arrangement 17 may comprise an electro-mechanical arrangement, such as a motor and associated control system. The resistance arrangement 17 may comprise some or all of the features of the arrangement disclosed in WO2016/170361, by the applicant.

The resistance arrangement 17 may further comprise at least one chain ring, or a cassette of chain rings (not shown). A chain (not shown) may then operatively connect the chain ring 25 in the pedal arrangement 13 with the chain ring(s) of the resistance arrangement 17, such that rotation of the pedal arrangement 13 causes corresponding rotation of the resistance arrangement 17. As is conventional, the ratio between the gears on the chain rings may differ, to provide a mechanical advantage. In embodiments where there are multiple chain rings in a cassette, a conventional derailleur can be provided to move the chain between chain rings to adjust the ratio. Each of the pedal arrangement 13 and resistance arrangement 17 may comprise more than one chain ring, with a corresponding derailleur provided.

In one embodiment, incorporating some or all of the features disclosed in WO2016/170361, the resistance arrangement may comprise a motor, with a feedback arrangement configured to detect the torque imposed by a user, and ether assist or resist the rotation by the user. In such an embodiment, gearing may be provided 'virtually', wherein the motor is controlled to resist the rotation by the user to an extent commensurate with a particular gear ratio (or a selected one of several gear ratios).

The drive module 11 further comprises a main housing 18. A cowling 19 may be provided over the resistance arrangement 17, to prevent injury to the user, to prevent foreign objects entering the drive module 11 and/or to provide aesthetic appeal. The cowling 19 may extend to surround the chain and any chain rings.

The base 10 comprises a bar 20, and at least two support arms 21. The support arms 21 extend away from the longitudinal axis of the support bar 20, so as to provide stability. Support feet 22 are provided at the ends of the support arms 21. In the embodiment shown, a pair of support arms 21 is attached to a support bracket 23, which is securable to the support bar 20 of the base 10. In at least one embodiment, the footprint defined by the four support feet 22 is substantially rectangular, having a length and width which is sufficient to provide stability to the exercise bike 1 in use.

The drive module 11 further comprises a bracket 24, which is securable to the support bar 20. The bracket is secured to the main housing 18

In the embodiment shown, the drive module 11 is mounted for rotation about the longitudinal axis of the base 10. For example, the bracket 24 of the drive module 11 may be secured to the support bar 20 with a roller bearing arrangement. The longitudinal axis of the base may be coaxial with or parallel to the support bar 20. Generally, the longitudinal axis travels along the length of the bike 1 and is generally horizontal. The bracket 24 may define or otherwise be connected to a sleeve which is mounted for rotation about the support bar 20. In at least one embodiment, the drive module 11 is biased into a predetermined angular position about the longitudinal axis of the base 10. In at least one embodiment, the drive module 11 may be biased into a substantially upright/vertical configuration. That is to say that the drive module 11 extends in a direction substantially perpendicular to the plane of the support feet 22, such that if the base 10 is positioned on a substantially horizontal surface, the drive module 11 will tend to extend substantially vertically upwards.

The biasing of the drive module 11 relative to the support bar 20 may be provided by an elastomeric member mounted at least partially within the support bar 20/bracket 24. One end of the elastomeric member may be secured to the support bar 20, and the other end of the elastomeric member may be secured to the drive module 11, such that rotation of the drive module 11 about the longitudinal axis of the support bar 20 imposes torsional forces on the elastomeric member. Consequently, the resiliency of the elastomeric member progressively opposes the torsional forces, so as to provide a reactionary biasing force.

The steering module 12 comprises a rotatable member 32. In the embodiment shown, the steering module 12 comprises a first member 31 and a second member 32. The first member 31 is secured to the base 10 and the second member 32 is coaxially journaled to the first member 31, for rotation about a steering axis 33. The bottom of the first member 31 may be provided with a bracket 34, for securing to the support bar 20. In the same or similar manner as for the drive module 11, the steering module 12 may be mounted for rotation about the longitudinal axis of the base 10. The steering module 12 may be biased into a predetermined angular position about the longitudinal axis of the base 10. The biasing force may be provided by an elastomeric member, as described above in relation to the drive module 11.

The first member 31 extends generally upwardly from the base 10. In the embodiment shown, the first member 31 does not extend perpendicularly from the longitudinal axis of the support bar 20, but at an angle which is slanted backwards relative to the front of the exercise bike 1. This is because, as is conventional, the steering axis 33 is angled with respect to the vertical.

The second member 32 may be journaled to the first member 31 by any conventional means. In at least one embodiment, as well as being rotationally mounted on the first member 31, the second member 32 may be translatable along the steering axis, relative to the first member 31. Consequently, the height of the steering module 12 may be adjustable. In such an embodiment, any conventional linear actuator may be used, such as a linear motor or other suitable electro-mechanical actuator.

The second member 32 is biased towards a predetermined angular position about the steering axis 33, relative to the first member 31.

In the embodiment shown, the steering module 12 further comprises a resilient member 37 which is attached between the first 31 and second 32 members, and is configured to resist rotation of the second member 32 relative to the first member 31 away from a predetermined angular position. In the embodiment shown, a mounting arm 35 extends substantially perpendicularly from the main body of the second member 32. Additionally, a lower mounting member 36 is provided on the base 10. The resilient member 37 is attached between the lower mounting member 36 and the mounting arm 35. The upper part of the resilient member 37 may be mounted to the arm 35 with a spherical bearing arrangement. In use, when the second member 32 is rotated about the steering axis 33, the resilient member 37 is caused to deform, which in turn provides a resilient biasing force, resisting further rotation of the second member 32 about the steering axis 33. The lower mounting member 36 may be rigidly attached to the support bar 20 or may be mounted for rotation about the longitudinal axis of the support bar 20 (and biased into a vertical position, as with the first member 31 and drive module 11).

Generally, the overall function of the drive module 11 and steering module 12 may be similar to those disclosed in GB2520677.

The exercise bike 1 further comprises a bike frame 40 which is removably attachable to the base. The bike frame 40, in the embodiment shown, comprises a top tube 41 and a down tube 43. A seat tube 42 extends between an end of the top tube 41 and an end of the down tube 43, in a substantially conventional manner. Furthermore, the bike frame 40 comprises a head tube 45, secured between the other ends of the top tube 41 and down tube 43. As is conventional, the top tube 41, seat tube 42, down tube 43 and head tube 45 present a substantially triangular shape. As is conventional, the seat tube 42 may be non-vertical, but this is not essential. The head tube 45 is not essential and there may be no head tube. Instead, the down tube 43 and top tube 41 may intersect with one another. The bike frame 40 may take other forms.

The bike frame 40 further comprises a steering actuator 46. The steering actuator 46 comprises a steering post 47 with a handle bar arrangement 48 attached thereto. The steering post 47 and handle bar arrangement 48 may be substantially conventional. Furthermore, at least one user input device 49 (such as a gear shifter and/or brake lever) may be connected to the handle bar arrangement 48, in a conventional way. The position of the handle bar arrangement 48 relative to the steering post 47 may be adjustable. In the embodiment shown, the steering arrangement 48 comprises a steering stem 50 extending from the steering post 47. The handle bar arrangement 48 may be slideably mounted on the steering stem 50, such that its position may be adjusted by a user.

The steering post 47 is rotatably received in the head tube 45, in a substantially conventional manner. In an embodiment without a separate head tube, the steering post 47 may otherwise be rotatably held at the intersection of the top tube 41 and down tube 43.

In the embodiment shown, the steering post 47 is removably attachable to the rotatable second member 32 of the steering module 12.

Figure 2:
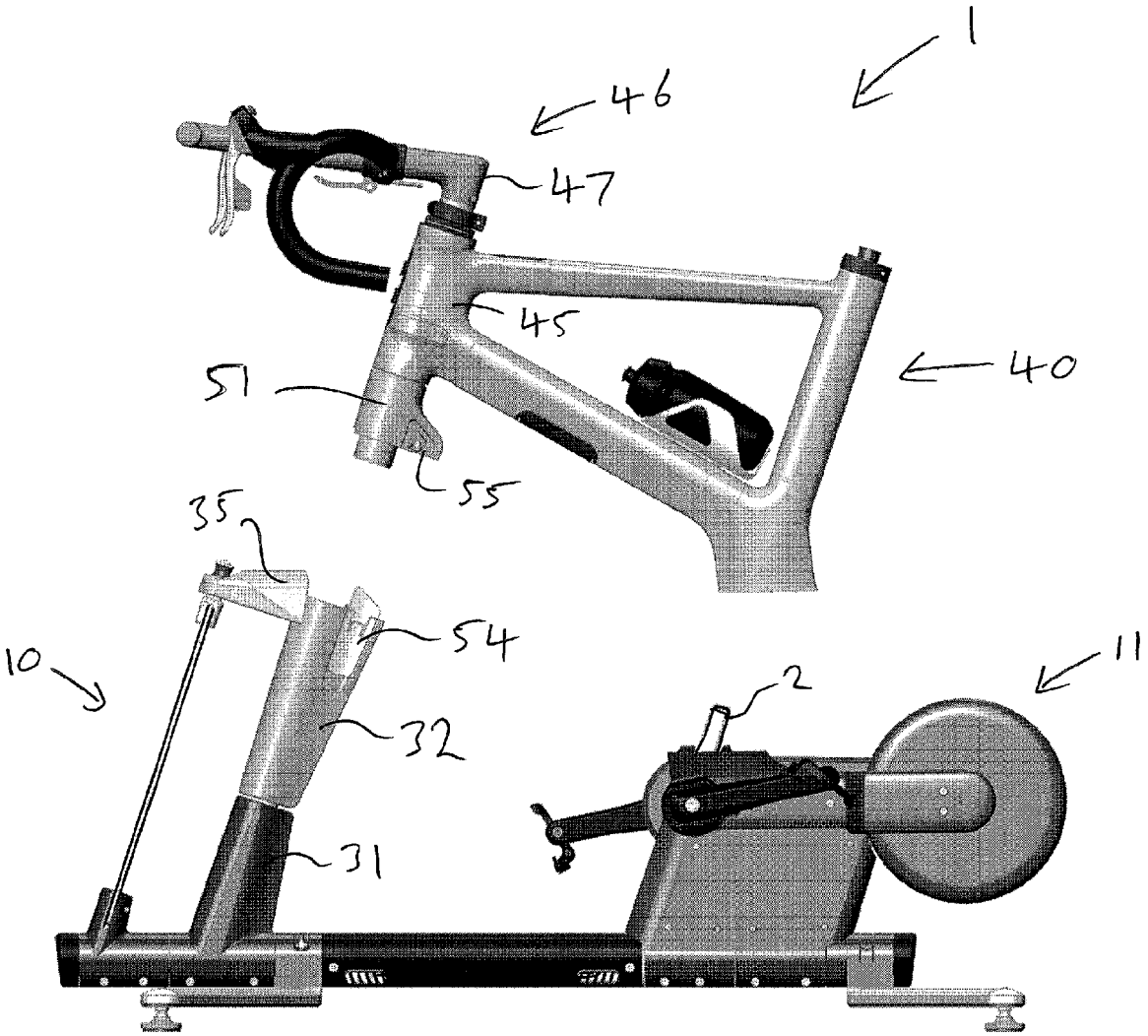
FIG. 2 illustrates the exercise bike of FIG. 1, with the bike frame removed from the base.
Figure 3:
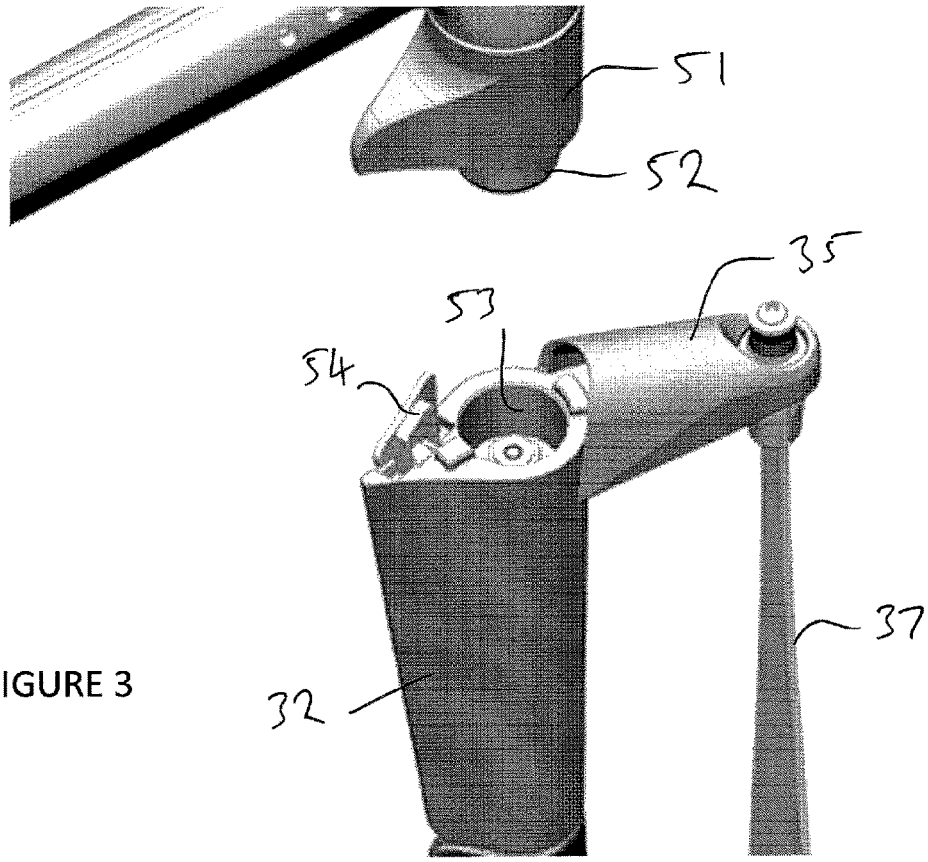
FIG. 3 illustrates the steering module of the exercise bike of FIG. 1.
Figure 4:
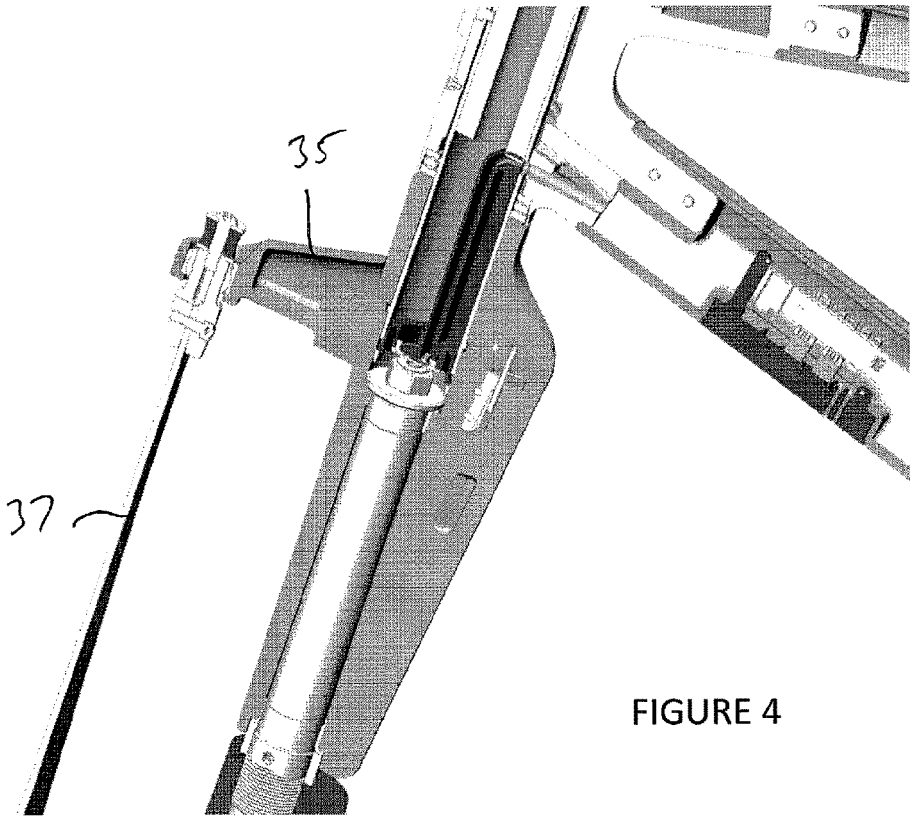
FIG. 4 shows a partial cross-section of the steering module with the bike frame attached thereto.

With reference to FIGS. 2 and 3, the bottom of the steering post 47 is provided with a drive shoe 51 which is selectively securable to the top of the second member 32 of the steering module 12. In the embodiment shown, with reference to FIG. 3, the shoe 51 comprises a boss 52 which is receivable in a corresponding socket 53 in the top of the second member 32. The top of the second member 32 comprises a latch member 54 which is removably securable to a catch member 55 on the shoe 51. The shoe 51 and second member 32 are configured such that, once attached to one another, rotation of the steering actuator 46 about the steering axis 33 causes corresponding rotation of the second member 32.

The socket 53 and/or boss 52 may comprise keying features (such as splines) to ensure the transfer of rotational forces across the interface. The latch member 54 may be spring loaded, such that once it is engaged with the catch member 55, a user must deliberately apply a force to the latch member 54 to release it from the catch member 55. This may prevent inadvertent detachment of the bike frame 40 from the base 10 in use. Other ways of connecting the bike frame 40 to the base 10 are possible. For example, an electromagnet arrangement may be used, which is energised when the exercise bike 1 is in use (and/or when a user is detected to be sitting on the saddle), to prevent disassembly. Only when the system is off (and/or the user is not detected) may the electromagnet be deactivated to allow disassembly.

In this way, the steering post 47 (and by extension, the frame 40) is removably attachable to the rotatable second member 32 of the steering module 12 (and by extension, the base 10).

Additionally or alternatively, the bike frame 40 is removably attachable to the drive module 11. One of the drive module 11 and bike frame 40 may be provided with a first connector which is configured to be removably secured to a corresponding second connector provided on the other of the bike frame 40 and drive module 11.

Figure 5:
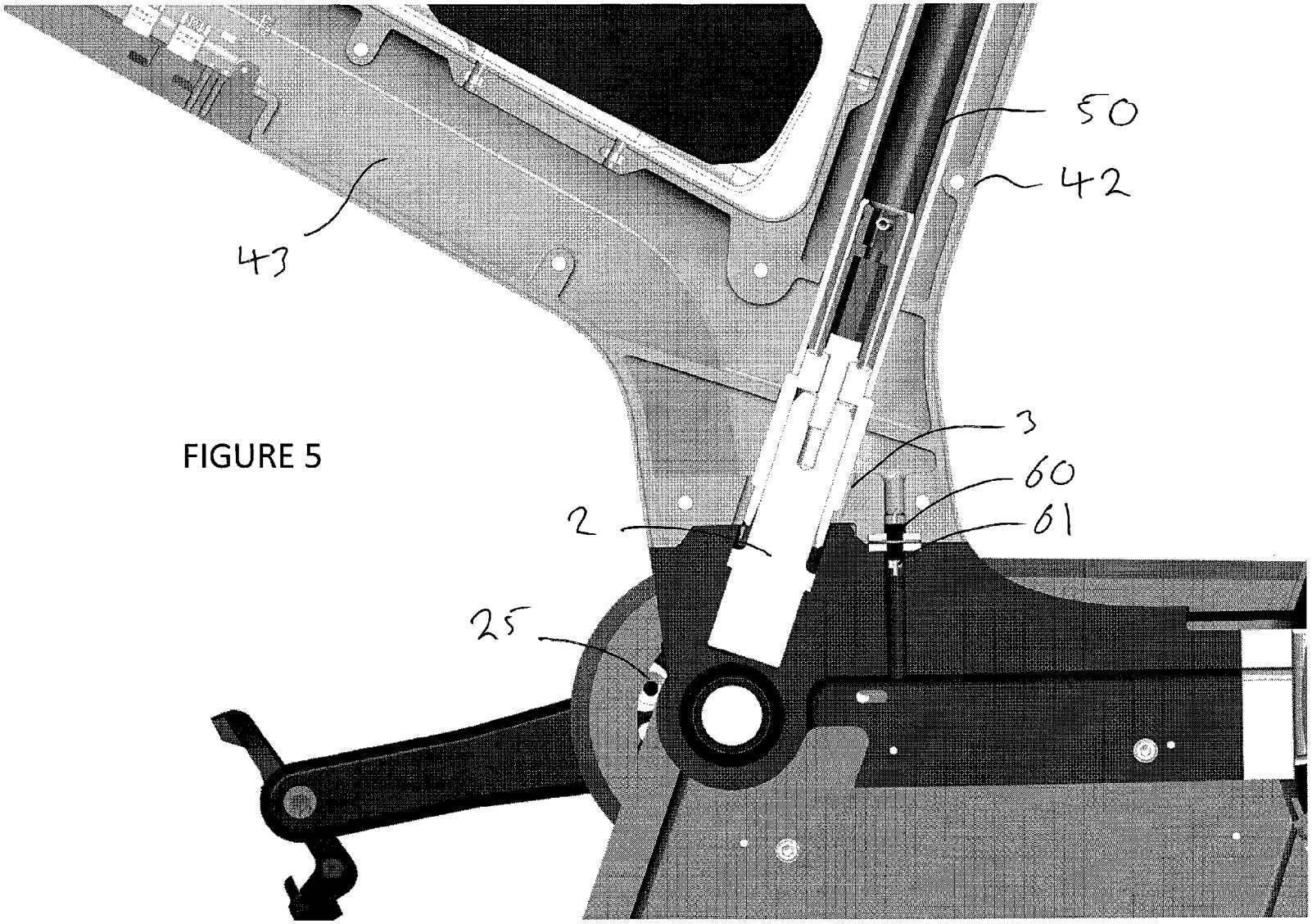
FIG. 5 illustrates a cross-sectional view of the connection between the bike frame and drive module.

With reference to FIG. 2, the drive module 11 may comprise a post 2 extending upwardly therefrom. The post 2 may be receivable in a corresponding socket 3 provided on the bottom of the bike frame 40, as shown in FIG. 5. The socket 3 is provided under the intersection of the down tube 43 and seat tube 42. In at least one embodiment, the exercise bike 1 further comprises a seat post (not shown) having a saddle attached thereto (not shown). The seat post and saddle may be substantially conventional in form. The seat post is receivable in the seat tube 42 of the frame 40. In at least one embodiment, the exercise bike 1 may be configured such that rotation of the seat post in a predetermined direction within the seat tube 42 selectively retains the bike frame 40 on the base 10. The height of the saddle may be adjustable by rotating the saddle and seat post in a predetermined direction (for example anti-clockwise), allowing the user to slide the seat post within the seat tube, before rotating the seat tube and saddle in the opposite direction (for example clockwise) which may have the dual function of securing the saddle relative to the seat tube but also securing the frame 40 to the drive module 11.

The position of the drive module 11 relative to the steering module 12 may be adjustable, in at least one of a vertical or horizontal direction. For example, the height of the steering module 12 and/or the height of the drive module 11 may be adjustable. This may be to accommodate different frame sizes or to adjust for the dimensions of the user.

In one embodiment, as illustrated with reference to FIGS. 7A and 7B, the height of the steering module 12 may adjustable, which causes the bike frame 40 to pitch upwards or downwards. This may be to simulate the sensation of riding up or down a hill. If the height of the drive module 11 otherwise does not change, vertical movement of the front of the bike frame 40 will urge the bike frame 40 to rotate about a pitch axis perpendicular to the longitudinal axis of the base 10.

Figure 7A:
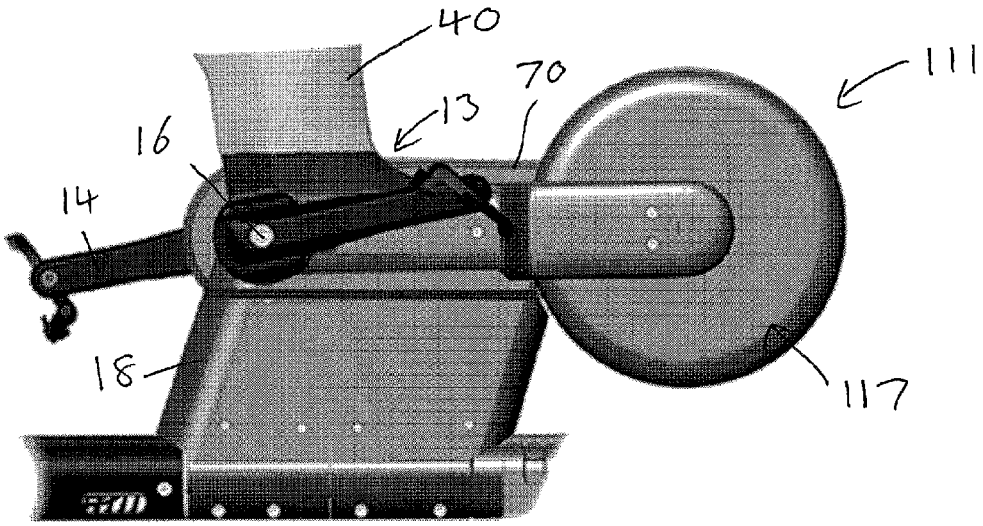
FIGS. 7*a* and 7*b* illustrate another embodiment of a drive module.
Figure 7B:
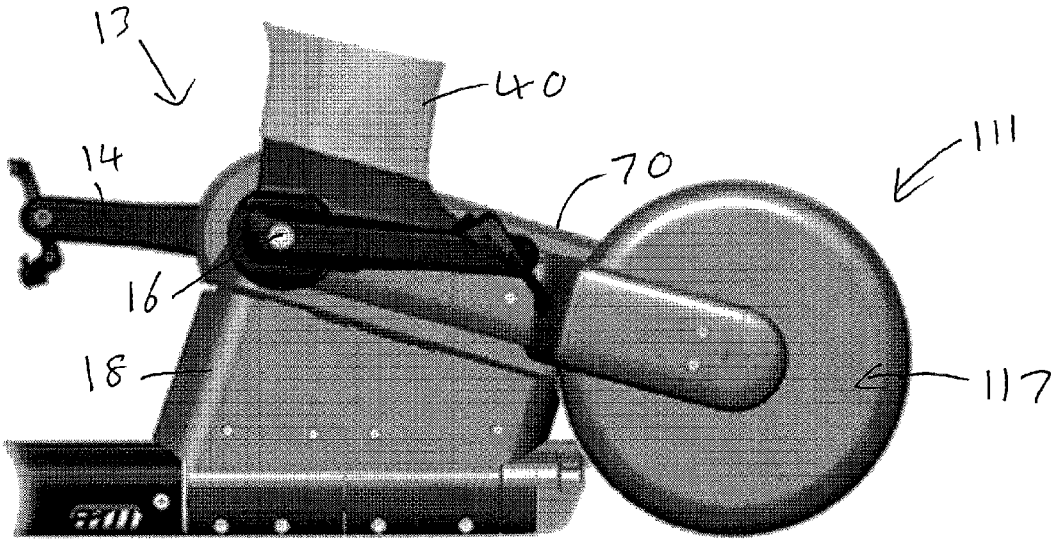

To accommodate this pitching, the drive module 111 shown in FIGS. 7A and 7B may comprise a rotatable platform 70, on which the pedal arrangement 13 and resistance arrangement 117 are mounted. The platform 70 may pivot with respect to the main housing 18, as illustrated in FIG. 7B. The platform 70 may be biased into a predetermined position relative to the main housing 18.

In the arrangement shown, the pitch axis is substantially coaxial with the rotational axis 16 of the pedal arrangement 13. This is not essential. The pitch axis may be proximal the pedal axis.

In an alternative arrangement, not shown, the drive module may not be mounted on a rotatable platform, but instead there is a pivoting connection between the bike frame 40 and drive module 11.

Figure 6:
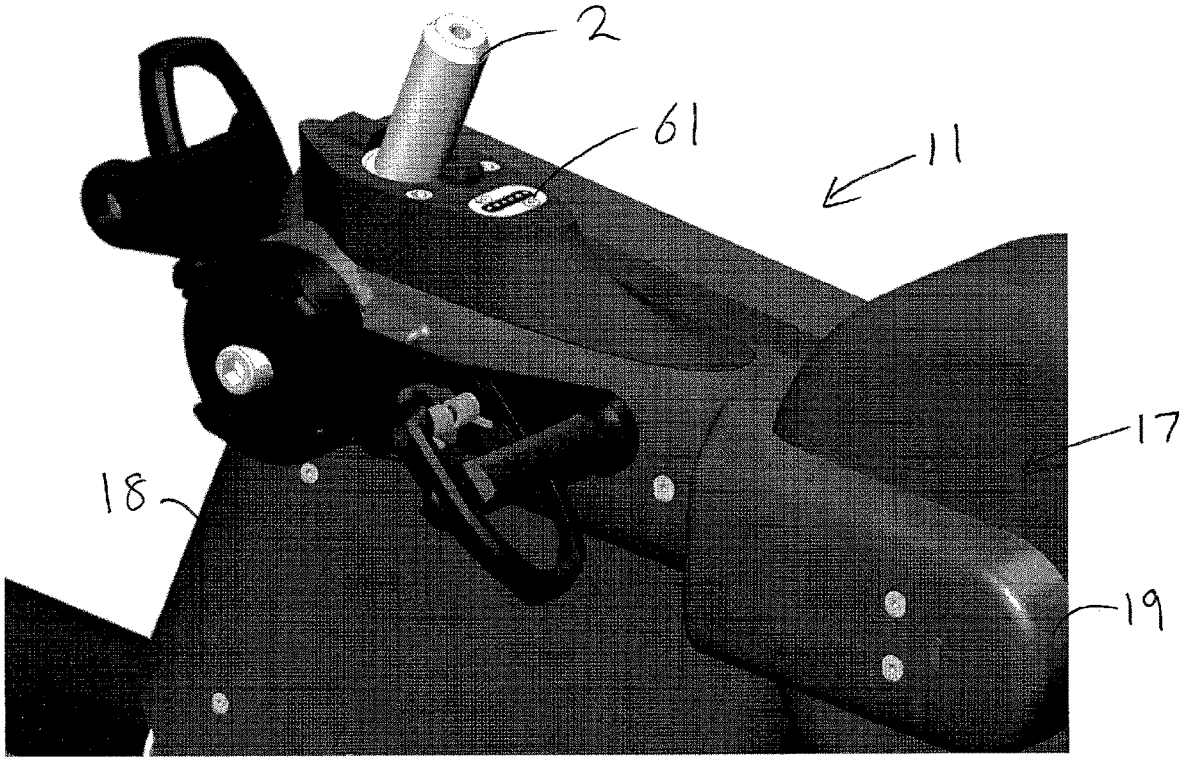
FIG. 6 illustrates the drive module of an exercise bike.

The bike frame 40 may further comprise at least one user input/output device connected to an interface terminal 60, and the base 10 may further comprise a corresponding interface connector 61 for connection to the interface terminal 60, for communication with the input/output device. As shown in FIG. 6, the interface connector 61 may comprise one or more pogo pins, and the interface terminal 60 may comprise one or more corresponding plates which electrically connect to each of the pogo pins of the interface connector 61. In an embodiment where the input/output device comprises gear shifters and/or brake levers, a signal may be sent to a controller, indicating that a user has operated one of the input/output devices. In at least one embodiment, there may be provided a user display, which may display various data to a user.

As illustrated in FIG. 2, the bike frame 40 (with any attached saddle and handle 25 bar arrangement) is removable from the base 10. The removability of the bike frame 40 from the base 10 may allow for easier storage and/or transportation of the exercise bike 1, since a user may more easily carry each of the two parts (the base 10 and the bike frame 40) individually. Another advantage may be that a user can swap one bike frame 40 for another bike frame 40. For example, one bike frame 40 may be configured as a road bike, whereas another bike frame may be configured as a time trial bike. Various other bike frame disciplines are possible. Alternatively or additionally, the bike frame may be replaced with one of a different size, for example a child's bike. To accommodate smaller/larger frames, the distance between the drive module 11 and steering module 12 may be adjustable, to account for a different length of down tube in the smaller/larger bike frame 40.

Where there are multiple users of the exercise bike 1, each user may have a preferred style/colour/surface decoration and/or have a different set-up on the various components. Providing a bike frame which is removably attachable to the base 10 of the exercise bike 1 allows for a user to quickly and conveniently swap between bike frames, minimising additional set-up time.

The exercise bike 1 may comprise at least one sensor, to detect movement and/or position. For example, there may be at least one sensor associated with the drive module and/or steering module to detect the angular motion of the drive/steering module relative to the base. There may be other sensors associated with the resistance module.

There may be at least one sensor associated with the steering module and/or the steering actuator, to detect movement and/or position of the second member 32 relative to the first member 31. This sensed angle may be used as an input to the controller. For example, if a user is using the exercise bike 1 to navigate through an interactive virtual world, the user's movement of the steering module may be used to control a direction to be taken on a route in the virtual world.

When used in this specification and claims, the terms "comprises" and "comprising" and variations thereof mean that the specified features, steps or integers are included.

The terms are not to be interpreted to exclude the presence of other features, steps or components.

The invention may also broadly consist in the parts, elements, steps, examples and/or features referred to or indicated in the specification individually or collectively in any and all combinations of two or more said parts, elements, steps, examples and/or features. In particular, one or more features in any of the embodiments described herein may be combined with one or more features from any other embodiment(s) described herein.

Protection may be sought for any features disclosed in any one or more published documents referenced herein in combination with the present disclosure.

Although certain example embodiments of the invention have been described, the scope of the appended claims is not intended to be limited solely to these embodiments. The claims are to be construed literally, purposively, and/or to encompass equivalents.

The invention claimed is:

1. An exercise bike comprising:

a base, comprising a drive module and a steering module, the drive module comprising a pedal arrangement operatively connected to a resistance arrangement, and the steering module comprising a rotatable member; and a bike frame removably attachable to the base, wherein the steering module is mounted for rotation about a longitudinal axis of the base.

2. The exercise bike according to claim 1, wherein the bike frame further comprises a head tube and a steering actuator, the steering actuator comprising a steering post with a handlebar attached thereto, the steering post rotatably received in the head tube.

3. The exercise bike according to claim 2, wherein the steering post is removably attachable to the rotatable member of the steering module.

4. The exercise bike according to claim 2, wherein one of the steering actuator and steering module is provided with a first connector which is configured to be removably secured to a corresponding second connector provided on the other of the steering module and steering actuator.

5. The exercise bike according to claim 1, wherein the steering module comprises a first member and a second member, wherein the first member is secured to the base and the second member is coaxially journaled to the first member, for rotation about a steering axis.

6. The exercise bike according to claim 5, wherein the second member is biased towards a predetermined angular position about the steering axis, relative to the first member.

7. The exercise bike according to claim 5, wherein the steering module further comprises a resilient member attached between the first and second members, configured to resist rotation of the second member relative to the first member away from a predetermined angular position.

8. The exercise bike according to claim 1, wherein the drive module is mounted for rotation about the longitudinal axis of the base.

9. The exercise bike according to claim 8, wherein the steering module and/or drive module are biased into a predetermined angular position about the longitudinal axis of the base, optionally;

wherein a biasing force is provided by an elastomeric element.

10. The exercise bike according to claim 1, wherein the bike frame is removably attachable to the drive module.

11. The exercise bike according to claim 1, wherein the bike frame is removably attachable to the steering module.

12. The exercise bike according to claim 1, wherein one of the drive module and bike frame is provided with a first connector which is configured to be removably secured to a corresponding second connector provided on the other of the bike frame and drive module.

13. The exercise bike according to claim 1, wherein a height of the steering module and/or drive module relative to the base is adjustable.

14. The exercise bike according to claim 1, wherein the bike frame is mounted for rotation about a pitch axis perpendicular to the longitudinal axis of the base, optionally;

wherein the pitch axis is in proximity to or substantially coaxial with the rotational axis of the pedal arrangement.

15. The exercise bike according to claim 1, further comprising a seat post having a saddle attached thereto, wherein the bike frame comprises a seat tube and down tube, and the seat post is received in the seat tube, optionally;

configured such that rotation of the seat post in a predetermined direction within the seat tube selectively retains the bike frame on the base.

16. The exercise bike according to claim 1, wherein the position of the drive module relative to the steering module is adjustable.

17. The exercise bike according to claim 1, wherein the bike frame comprises at least one user input/output device connected to an interface terminal, wherein the base comprises a corresponding interface connector for connection to the interface terminal for communication with the input/output device.

18. The exercise bike according to claim 1, further comprising at least one controller.

19. The exercise bike according to claim 1, wherein the resistance arrangement comprises a motor and/or flywheel.

20. An exercise bike kit comprising the exercise bike according to claim 1, comprising a plurality of said bike frames, optionally;

wherein the plurality of bike frames are dissimilar in at least one of size, geometry, style, colour, surface decoration, groupset, pattern, shape or discipline.

* * * * *